US006880341B2

(12) United States Patent
Parkman et al.

(10) Patent No.: US 6,880,341 B2
(45) Date of Patent: Apr. 19, 2005

(54) LOW COST COMBUSTOR FLOATING COLLAR WITH IMPROVED SEALING AND DAMPING

(75) Inventors: Kenneth Parkman, Mississauga (CA); Saeid Oskooei, Toronto (CA)

(73) Assignee: Pratt & Whitney Canada Corp., Quebec (CA)

( * ) Notice: Subject to any disclaimer, the term of this patent is extended or adjusted under 35 U.S.C. 154(b) by 0 days.

(21) Appl. No.: 10/321,571

(22) Filed: Dec. 18, 2002

(65) Prior Publication Data

US 2004/0118121 A1 Jun. 24, 2004

(51) Int. Cl.[7] ..... F02C 1/00; F02G 3/00
(52) U.S. Cl. ..... 60/740; 60/799; 60/748
(58) Field of Search ..... 60/799, 800, 740, 60/748, 737; 239/403, 405, 406

(56) References Cited

U.S. PATENT DOCUMENTS

| | | | | |
|---|---|---|---|---|
| 3,703,259 A | * | 11/1972 | Sturgess et al. | 239/400 |
| 3,879,940 A | | 4/1975 | Stenger et al. | |
| 3,910,036 A | | 10/1975 | Irwin | |
| 3,911,672 A | | 10/1975 | Irwin | |
| 4,322,945 A | * | 4/1982 | Peterson et al. | 60/800 |
| 4,365,470 A | * | 12/1982 | Matthews et al. | 60/800 |
| 4,454,711 A | | 6/1984 | Ben-Porat | |
| 4,606,190 A | * | 8/1986 | Greene et al. | 60/39.23 |
| 4,870,818 A | * | 10/1989 | Suliga | 60/740 |
| 4,999,996 A | * | 3/1991 | Duchene et al. | 60/798 |
| 5,197,290 A | * | 3/1993 | Lee et al. | 60/748 |
| 5,222,358 A | | 6/1993 | Chaput et al. | |
| 5,987,879 A | | 11/1999 | Ono | |
| 6,199,367 B1 | * | 3/2001 | Howell | 60/39.23 |
| 6,351,949 B1 | | 3/2002 | Rice et al. | |
| 6,581,386 B1 | * | 6/2003 | Young et al. | 60/748 |

FOREIGN PATENT DOCUMENTS

| | | |
|---|---|---|
| EP | 1 096 207 | 5/2001 |
| GB | 2134640 | 8/1984 |
| JP | 05118549 | 5/1993 |

* cited by examiner

*Primary Examiner*—Cheryl J. Tyler
*Assistant Examiner*—William H. Rodriguez
(74) *Attorney, Agent, or Firm*—Ogilvy Renault

(57) ABSTRACT

A floating collar assembly for damping vibration and sealing between a combustor and a fuel nozzle of a gas turbine engine. The combustor has a nozzle opening with an outer peripheral abutment surface and the nozzle is integral with an internal fuel manifold that is secured to the engine core relative to the combustor. The nozzle has a cylindrical body aligned with the nozzle opening and has a shoulder laterally extending from the nozzle body. An annular floating collar has a combustor face adapted for radial sliding engagement with the abutment surface, a central aperture adapted for axial sliding engagement with the cylindrical body and an outer bearing surface. A wave spring is disposed between the outer bearing surface of the floating collar and an inner surface of the nozzle shoulder, for maintaining sealing engagement, for damping vibration, and for impeding relative rotation between the nozzle and the combustor, while accommodating axial and radial relative displacement.

17 Claims, 4 Drawing Sheets

LOW COST COMBUSTOR FLOATING COLLAR WITH IMPROVED SEALING AND DAMPING

TECHNICAL FIELD

The invention relates to a floating collar assembly for damping vibration and sealing between a combustor and a fuel nozzle of a gas turbine engine.

BACKGROUND OF THE ART

Floating collars are used to seal the fuel nozzles that are mounted in openings within an engine combustor wall in a gas turbine engine. The fuel nozzles protrude through the floating collar which is mounted in an opening in the combustor wall to accommodate relative movement necessary to deal with thermal expansion and contraction. In most prior art designs, the combustor is a relative thin sheet metal walled structure supported within a plenum filled with compressed air. The compressed air typically enters the combustor through various openings in the nozzle to create a swirling effect and through openings in the combustor to create cooling film and mix with the fuel aerosol sprayed within the combustor.

Fuel nozzles may be mounted at the inward ends of cantilevered fuel tubes where fuel tubes are individually fixed to an engine core structure and are supplied with liquid fuel via an external fuel supply manifold. Alternatively, fuel nozzles may extend into contact with the combustor from an internal fuel supply manifold assembly. To accommodate relative axial and radial motion between the nozzle and the combustor due to thermal expansion and contraction and to control the flow of air from the plenum into the combustor, floating collars have been used in the prior art. A disadvantage of prior art floating collars is that complex anti-rotation devices are often necessary to prevent the rotation of the floating collar due to swirling airflows and vibration. Continued rotation would quickly wear away the nozzle surface and is prevented by locking devices that permit some radial or axial motion to accommodate thermal expansion and contraction while preventing rotation.

Conventional collars are also subject to vibration fretting of the combustor wall due to significant vibration since the nozzles are often supported on the ends of slender cantilevered fuel tubes anchored at a distance from the nozzle to the engine core structure.

U.S. Pat. No. 4,322,945 to Peterson et al. discloses a conventional fuel nozzle heat shield with anti-rotation device included.

U.S. Pat. No. 4,454,711 to Ben-Porat discloses another example of means to accommodate relative motion between the nozzle and supply fuel tube and the combustor. In the case of Ben-Porat, a spherical ball end socket joint is provided with spring loaded mount in a relatively complex assembly.

It is an object of the present invention to mechanically dampen vibration between the fuel nozzle and combustor by providing friction both axially and radially between the nozzle and combustor.

It is a further object of the invention to prevent generation of high vibratory stresses through mechanically dampening vibration between the nozzles and combustor.

Further objects of the invention will be apparent from review of the disclosure, drawings and description of the invention below.

DISCLOSURE OF THE INVENTION

The invention provides a floating collar assembly for damping vibration and sealing between a combustor and a fuel nozzle of a gas turbine engine. The combustor has a nozzle opening with an outer peripheral abutment surface and the nozzle is mounted at a cantilever end of a fuel tube with its opposite end secured to the engine core. The nozzle has a cylindrical body aligned with the nozzle opening and has a shoulder laterally extending from the nozzle body. An annular floating collar has a combustor face adapted for radial sliding engagement with the abutment surface, a central aperture adapted for axial sliding engagement with the cylindrical body and an outer bearing surface. A wave spring is disposed between the outer bearing surface of the floating collar and an inner surface of the nozzle shoulder, for maintaining sealing engagement, for damping vibration, and for impeding relative rotation between the nozzle and the combustor, while accommodating axial and radial relative displacement.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
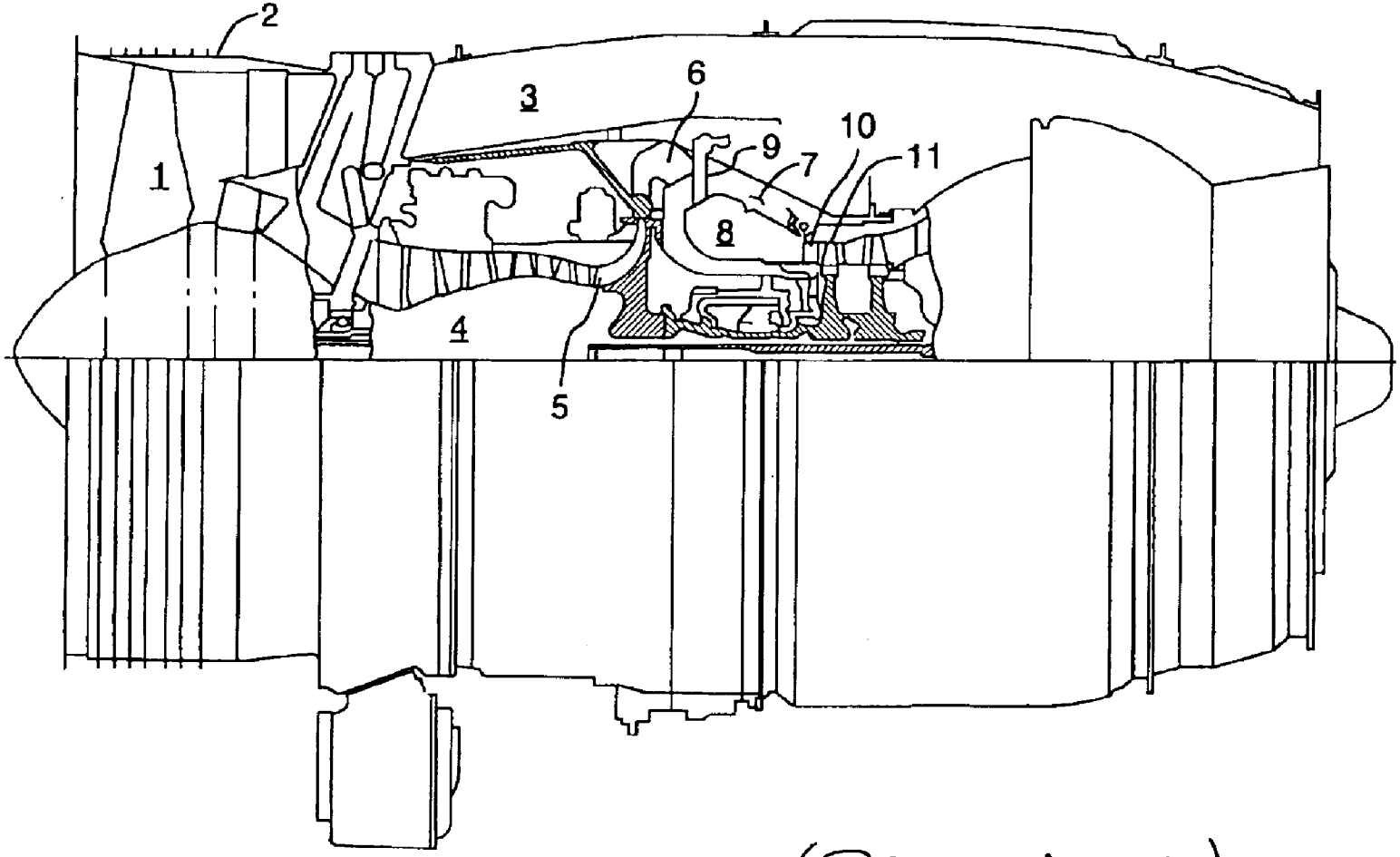
FIG.1 (PRIOR ART)
FIG. 1 is an axial cross-sectional view through a typical turbofan gas turbine engine showing the general arrangement of components and in particular showing the disposition of the combustor and fuel tube mounted to the engine core.

FIG. 1 shows an axial cross-section through a turbofan gas turbine engine. It will be understood however that the invention is equally applicable to any type of engine with nozzle floating collars, a combustor and turbine section such as a turboshaft, a turboprop, or auxiliary power unit. Air intake into the engine passes over fan blades 1 in a fan case 2 and is then split into an outer annular flow through the bypass duct 3 and an inner flow through the axial compressor 4 and centrifugal compressor 5. Compressed air exits the centrifugal compressor 5 through a diffuser 6 and is contained within a plenum 7 that surrounds the combustor 8. Fuel is supplied to the combustor 8 through fuel tubes 9 which is mixed with air from the plenum 7 when sprayed through nozzles into the combustor 8 as a fuel air mixture that is ignited. A portion of the compressed air within the plenum 7 is admitted into the combustor 8 through orifices in the combustor walls to create a cooling air curtain along the combustor walls or is used for cooling to eventually mix with the hot gases from the combustor and pass over the nozzle guide vane 10 and turbines 11 before exiting the tail of the engine as exhaust.

Figure 2:
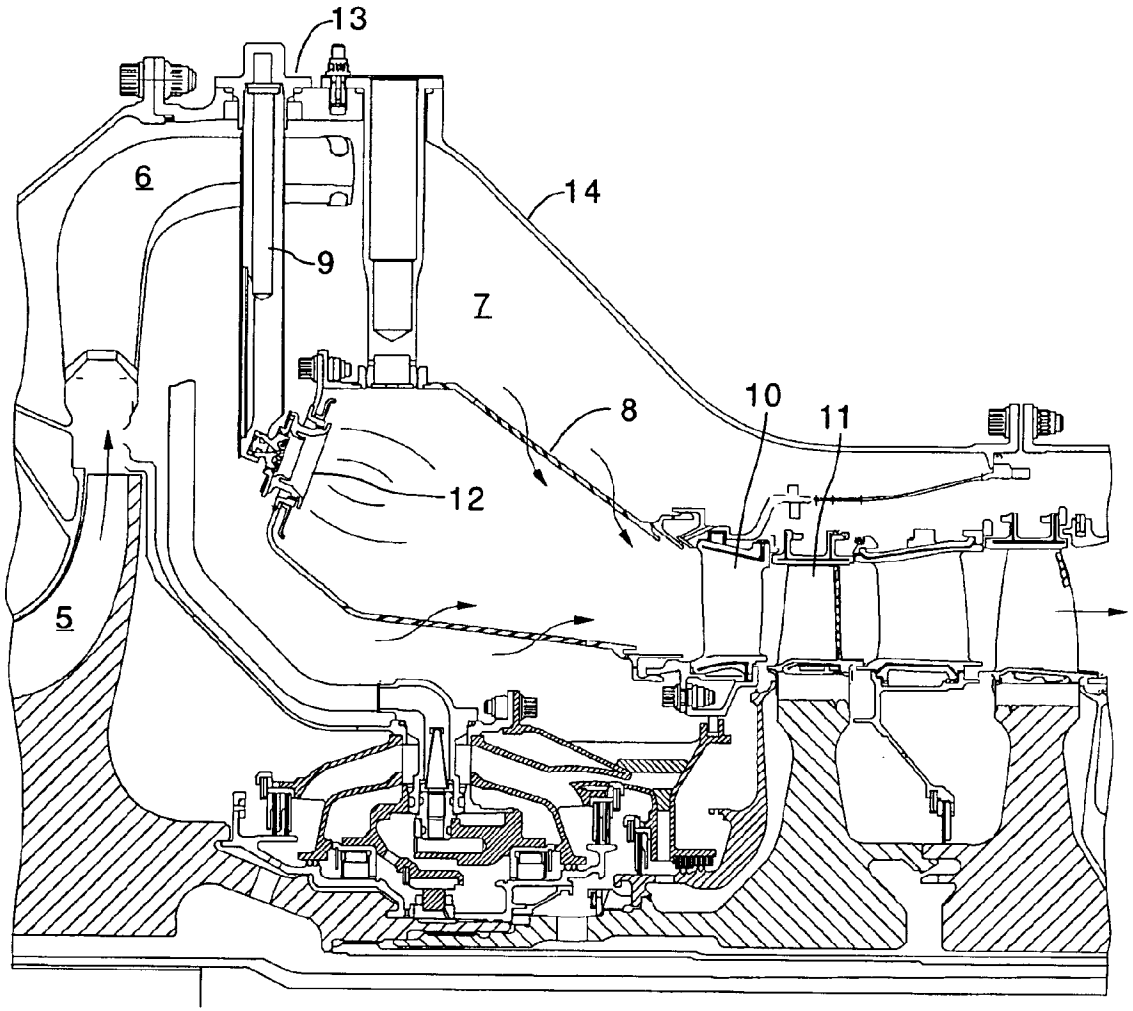
FIG.2 (Prior Art)
FIG. 2 is a detailed axial cross-sectional view through a prior art combustor with nozzles mounted to fuel tubes fixed to an outer engine casing wall.

As shown in FIG. 2, the fuel nozzle 12 is mounted within a nozzle opening in the combustor 8. The fuel nozzle 12 is mounted to an inward end of the fuel tube 9. An outward end 13 of the fuel tube 9 is secured to the engine core 14 and supplied with fuel via an external manifold (not shown). The conventional design shown in FIG. 2 must accommodate relative thermal expansion and contraction between the relatively thin walled combustor 8 and the cantilever mounted fuel tube 9, and particularly motion between the fuel nozzle 12 and the end wall of the combustor 8. As mentioned above, conventional anti-rotation devices are utilized in the prior art adding to complexity of the design.

Figure 3:
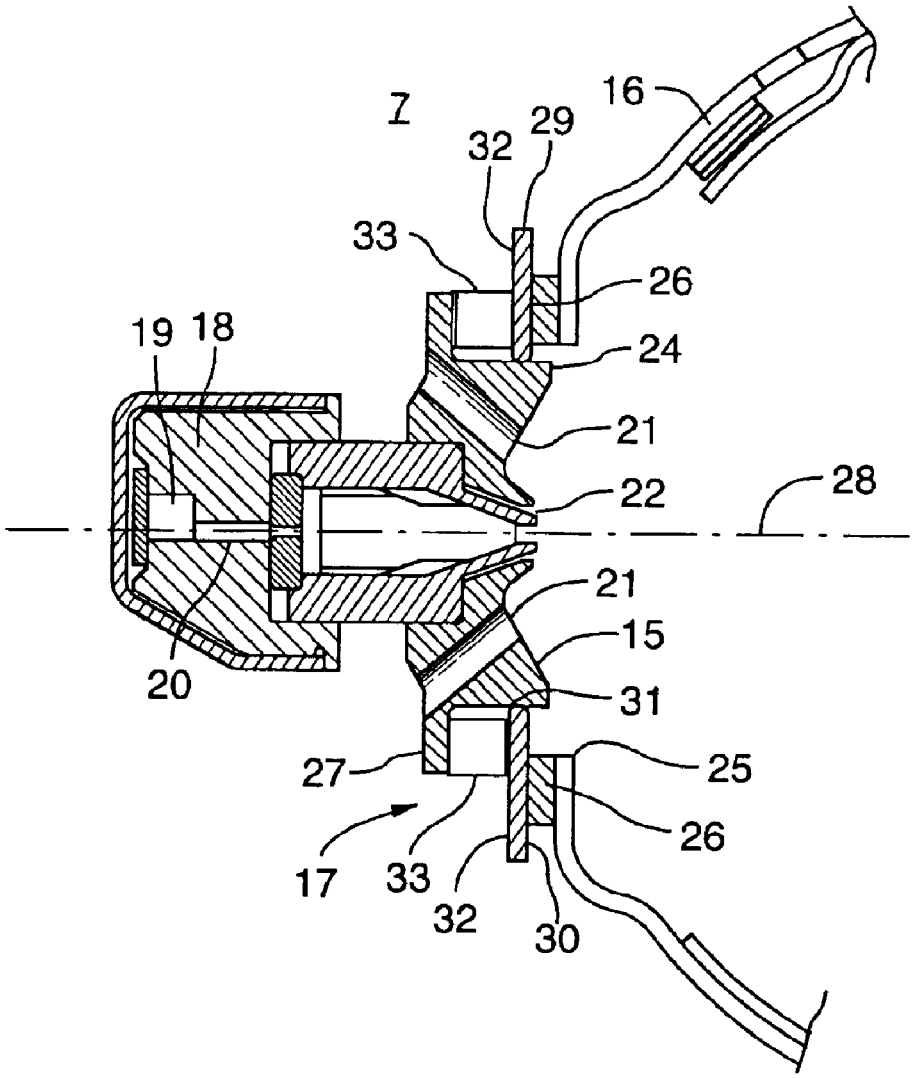
FIG. 3 is an axial cross-sectional view through combustor wall and nozzle including the floating collar in accordance with the present invention.
Figure 4:
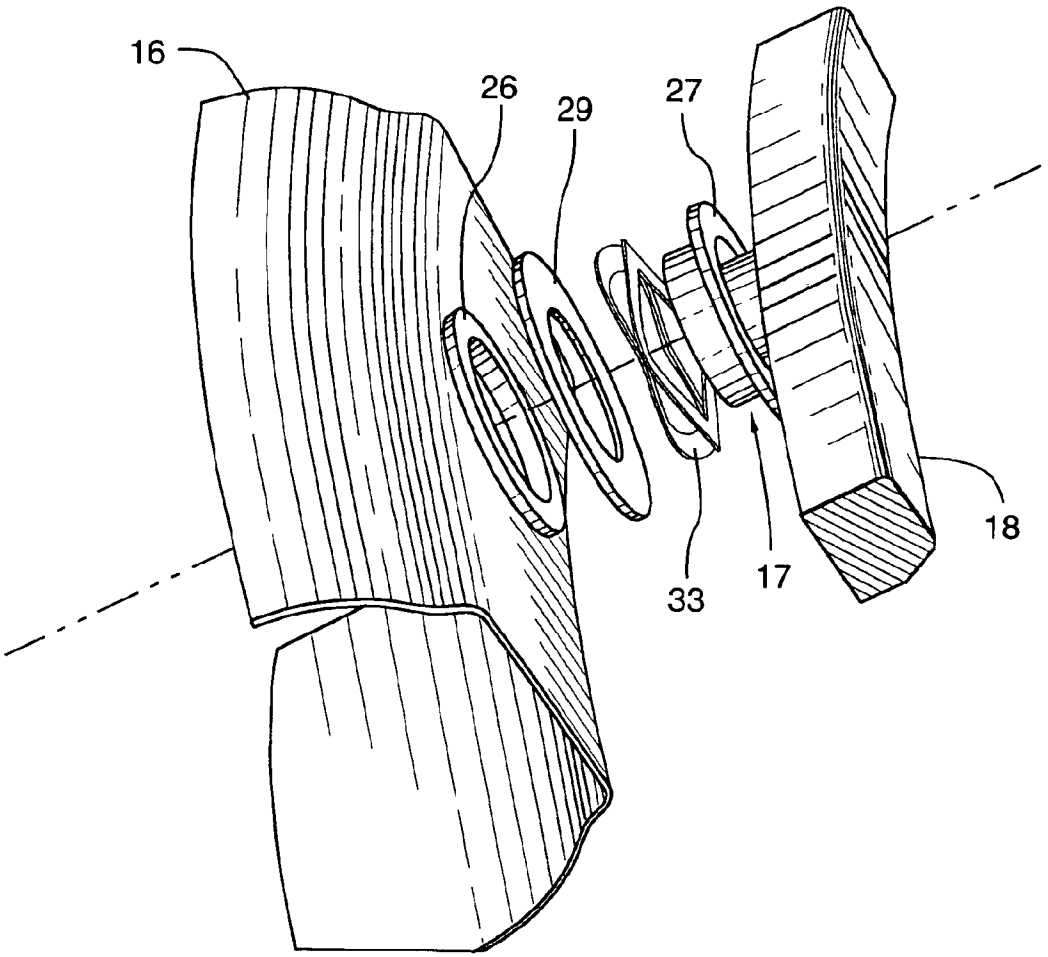
FIG. 4 is an isometric exploded view showing the floating collar assembly.

FIG. 3 shows a fuel nozzle 15 in accordance with the invention mounted to a combustor wall 16 with a floating collar assembly 17 in accordance with the invention. FIG. 3 shows a cross-sectional view through an annular internal fuel manifold 18 with a fuel supply slot 19 providing a flow of liquid fuel through the central bore 20. Compressed air from the plenum 7 is conducted through openings 21 to mix with the atomized fuel conducted through the fuel delivery port 22 to create a swirling effect with compressed air conducted through openings 21.

The nozzle 15 has a cylindrical body 24 aligned with the nozzle opening 25 in the combustor wall 16. The nozzle opening 25 is surrounded by an outer peripheral abutment surface 26, which in the embodiment shown is a flat annular surface. The nozzle 15 also includes a shoulder 27 extending laterally from the cylindrical body 24. In the embodiment shown in FIG. 3, the axis 28 of the nozzle 15 is aligned on the centre line of the nozzle opening 25 however it will be understood that relative axial and radial displacements will occur due to vibration and thermal expansion and contraction during different operational modes.

An annular floating collar 29 has a combustor face 30 adapted for radial sliding engagement with the abutment surface 26, and a central aperture 31 adapted for axial sliding engagement with the cylindrical body 24 of the nozzle 15, in order to effectively seal the combustor wall 16 from uncontrolled entry of compressed air from the plenum 7. In this manner, compressed air from the plenum 7 is directed to openings 21 and other openings in the combustor wall 16 (not shown).

Between an outer bearing surface 32 of the floating collar 29 and an inner surface of the nozzle shoulder 27, a wave spring 33 is provided. It will be understood that the internal fuel supply manifold 18 is integral with the nozzle 15 and supports the nozzle 15 in position relative to the combustor 8. The biasing force of the wave spring 33 accommodates relative axial and radial displacement between the nozzle 15 and the combustor wall 16 while maintaining a sealing engagement between a floating collar 29 and the abutment surface 26. The biasing force of the wave spring 33 also maintains engagement between the central aperture 31 of the floating collar 29 and the cylindrical surface 24 of the nozzle 15.

The biasing force of the wave spring 33 also mechanically dampens vibration modes between the nozzle 15 and the combustor wall 16 during all engine operating ranges. By dampening vibration, generation of high vibratory stresses are inhibited as well as fretting between the nozzle 15 and combustor wall 16. The wave spring 33 provides biased resistance axially to relative displacement between the nozzle 15 and combustor wall 16, and frictional contact between the cylindrical surface 24 of the nozzle 15 and central aperture 31 of the floating collar 29. The axially directed resilient force of the lead wave spring 33 serves to dampen axially directed components of the vibratory and thermal displacements.

Friction in a radial plane between the outer bearing surface 32 of the floating collar 29 and the engaging surfaces of the wave spring 33, and radial friction between the inner surfaces of shoulder 27 of the fuel nozzle 15 and the engaging surfaces of the wave spring 23 is sufficient to dampen the radial component of any relative deflection or vibration between the nozzle 15 and combustor wall 16. Radial Friction induced by the wave spring 33 is also sufficient to eliminate the need for anti-rotation devices on the floating collar 29.

Therefore, the floating collar assembly 17 of the invention accommodates axial and radial motion between the nozzle 15 and combustor wall 16 due to thermal expansion and contraction. The biasing force of the wave spring 33 contributes to the sealing of the combustor 16 to control flow of compressed air from the plenum 7 into the interior of the combustor 8. The floating collar assembly 17 generates friction in the radial direction to eliminate fretting and eliminates the need for a complex anti-rotation device of the prior art floating collars. Friction is also developed in an axial direction between the cylindrical body 24 of the nozzle 15 and the central aperture 31 of the floating collar 29 which together with the resilient force of the wave spring 33 serves to dampen axial components of the vibratory modes. The radial friction induced by the wave spring 33 dampens the radial component of vibratory modes thereby reducing the vibratory stresses induced in the nozzle 15 and in the combustor wall 16.

Although the above description relates to a specific preferred embodiment as presently contemplated by the inventor, it will be understood that the invention in its broad aspect includes mechanical and functional equivalents of the elements described herein.

What is claimed is:

1. A floating collar assembly for damping vibration and sealing between a combustor and a fuel nozzle of a gas turbine engine, the combustor having a nozzle opening with an outer peripheral abutment surface, the nozzle including a body aligned with said nozzle opening, and a shoulder laterally extending from said body, the floating collar assembly comprising:

an annular floating collar having a combustor face being in radial sliding engagement with said abutment surface, a central aperture being in axial sliding engagement with the nozzle body, and an outer bearing surface; and biasing means, disposed between the outer bearing surface of the floating collar and an inner surface of the nozzle shoulder, for maintaining sealing engagement, for damping vibration, and for impeding relative rotation between the nozzle and the combustor, while accommodating axial and radial relative displacement.

2. A floating collar assembly according to claim 1 wherein the biasing means biases the nozzle away from the combustor.

3. A floating collar assembly according to claim 1 wherein the biasing means comprises a spring.

4. A floating collar assembly according to claim 3 wherein the spring is a wave spring.

5. A floating collar assembly according to claim 1 wherein the biasing means resiliently engage the body of the nozzle.

6. A floating collar assembly according to claim 1 wherein the collar engages the combustor only at the abutment surface.

7. A floating collar assembly according to claim 1 wherein axial movement of the collar is restrained on one side by the abutment surface and on another side by the biasing means.

8. A floating collar assembly according to claim 1, wherein the biasing means maintains a sealing engagement between the collar and the abutment surface.

9. A floating collar assembly according to claim 1, wherein wherein the biasing means directly contacts the outer bearing surface of the collar.

10. A floating collar assembly for a combustor fuel nozzle of a gas turbine engine, the combustor having a nozzle opening with an outer peripheral abutment surface, the nozzle including a body aligned with said nozzle opening, and a shoulder laterally extending from said body, the floating collar assembly comprising:

an annular floating collar having a combustor face being in radial sliding engagement with said abutment surface, a central aperture being in axial sliding engagement with the nozzle body, and an outer bearing surface; and biasing member, disposed between the outer bearing surface of the floating collar and an inner surface of the nozzle shoulder, the biasing member urging the nozzle away from the combustor.

11. A floating collar assembly according to claim 10 wherein the biasing member comprises a spring.

12. A floating collar assembly according to claim 11 wherein the spring is a wave spring.

13. A floating collar assembly according to claim 10 wherein the biasing member resiliently engages the body of the nozzle.

14. A floating collar assembly according to claim 10 wherein the collar engages the combustor only at the abutment surface.

15. A floating collar assembly according to claim 10 wherein axial movement of the collar is restrained on one side by the abutment surface and on another side by the biasing member.

16. A floating collar assembly according to claim 10 wherein the biasing member biases the collar assembly towards the abutment surface, thereby maintaining engagement therebetween.

17. A floating collar assembly according to claim 10, wherein wherein the biasing member directly contacts the outer bearing surface of the collar.

* * * * *